United States Patent [19]

Ausiello et al.

[11] Patent Number: 5,011,082

[45] Date of Patent: Apr. 30, 1991

[54] PERFECTED DIESEL ENGINE ELECTROMAGNETIC FUEL INJECTOR

[75] Inventors: Francesco P. Ausiello, Bologna; Mario Ricco, Bari, both of Italy

[73] Assignee: Weber S.r.l., Torino, Italy

[21] Appl. No.: 485,617

[22] Filed: Feb. 27, 1990

[30] Foreign Application Priority Data

Mar. 3, 1989 [IT] Italy ..... 67146 A/89

[51] Int. Cl.[5] ..... F02M 59/00; F02M 47/02

[52] U.S. Cl. ..... 239/585; 239/124; 239/96; 239/533.2

[58] Field of Search ..... 239/124, 125, 533.2, 239/533.3, 533.4, 533.9, 585, 96, 533.5, 533.6, 533.7, 533.8, 533.11, 533.12

[56] References Cited

U.S. PATENT DOCUMENTS

| | | | |
|---|---|---|---|
| 4,129,256 | 12/1978 | Bader, Jr. et al. | 239/96 |
| 4,360,163 | 11/1982 | Williams | 239/124 |
| 4,566,417 | 1/1986 | Berchtold | 239/585 X |
| 4,585,171 | 4/1986 | Schmidt et al. | 239/124 X |

FOREIGN PATENT DOCUMENTS

| | | | |
|---|---|---|---|
| 0304749 | 3/1989 | European Pat. Off. | 239/585 |

*Primary Examiner*—Andres Kasknikow
*Assistant Examiner*—Lesley D. Morris
*Attorney, Agent, or Firm*—Jeffers, Hoffman & Niewyk

[57] ABSTRACT

A perfected fuel injector comprising a plunger for controlling fuel passage between an injection chamber and at least an injection orifice formed in an injection nozzel; and an electromagnetic fuel metering valve for controlling fuel passage through a drain orifice between a control chamber, supplied with fuel under pressure, and a low-pressure chamber, so as to reduce to a given value the pressure of the fuel inside the control chamber and so displace the plunger. Pressurized fuel is supplied to the injection chamber and control chamber by means of a single fitting connected to a supply pipe and coming out inside a supply orifice formed in the injector body and communicating with the control chamber and with a duct supplying fuel to the injection chamber and comprising an annular chamber and a radial hole formed in a sleeve housed in a hole on the body.

4 Claims, 1 Drawing Sheet

PERFECTED DIESEL ENGINE ELECTROMAGNETIC FUEL INJECTOR

BACKGROUND OF THE INVENTION

The present invention relates to a perfected electromagnetic fuel injector for Diesel engine application, particularly of the type described in Patent Application n.67134-A/89 filed by the present Applicant on Feb. 28, 1989 and entitled "Diesel engine electromagnetic fuel injector".

Said injector comprises a plunger sliding inside the injector body, for controlling fuel passage between an injection chamber, supplied with fuel under pressure, and at least one injection orifice formed in an injection nozzle secured to the body; and an electromagnetic fuel metering valve for controlling fuel passage through a drain orifice between a control chamber, supplied with fuel under pressure, and a low-pressure chamber, and reducing the pressure of the fuel in said chamber by draining the same through said orifice.

Appropriate surface portions of the plunger are exposed to the fuel inside the injection and control chambers, so that the pressures inside the same and exerted on said surface portions raise the plunger when the pressure inside the control chamber falls to a given value, thus enabling fuel supply through the injection orifices on the nozzle.

Fuel under pressure is supplied to the injection and control chambers by means of a single fitting connected to a supply pipe and coming out inside a supply orifice formed in the body and communicating with the control chamber and with a supply duct for feeding fuel into the injection chamber; which duct is substantially formed inside a series of sleeves housed inside an axial hole in the body and inside which the plunger slides axially. Though highly satisfactory in term of operation and reliability, the above injector cannot normally be employed on all types of engines, by virtue of the fall in pressure depending on the size of the fuel supply orifice to the control chamber, and being specifically related to the design of the engine in question.

SUMMARY OF THE INVENTION

The aim of the present invention is to provide an injector of the aforementioned type, designed for fitment to engines of different types.

With this aim in view, according to the present invention, there is provided a Diesel engine electromagnetic fuel injector comprising:

a plunger sliding inside the injector body, for controlling fuel passage between an injection chamber, supplied with fuel under pressure, and at least one injection orifice formed in an injection nozzle secured to said body;

an electromagnetic fuel metering valve for controlling fuel passage, through a drain orifice, between a control chamber, supplied with fuel under pressure, and a low-pressure chamber, so as to reduce the pressure of the fuel in said control chamber by draining the same through said orifice;

surface portions of said plunger being exposed to the fuel inside said injection chamber and said control chamber, so that the pressures inside said chambers and acting on said surface portions displace said plunger when the pressure in said control chamber falls to a given value;

said fuel under pressure being supplied to said injection chamber and said control chamber by means of a single fitting connected to a supply pipe and coming out inside a supply orifice formed in said body and communicating with said control chamber and with a supply duct for feeding fuel into said injection chamber and substantially formed inside a series of sleeves housed inside an axial hole in said body and inside which said plunger slides axially;

characterised by the fact that said fuel supply orifice comes out inside an annular chamber formed between the outer surface of the top sleeve in said series and said axial hole in said body; said annular chamber communicating with said control chamber via at least one radial hole formed in said sleeve, and with a helical groove formed on the outer surface of said sleeve and defining the first portion of said duct supplying fuel to said injection chamber.

BRIEF DESCRIPTION OF THE DRAWINGS

The invention will be described by way of example with reference to the accompanying drawings, in which.

DETAILED DESCRIPTION OF THE INVENTION

Figure 1:
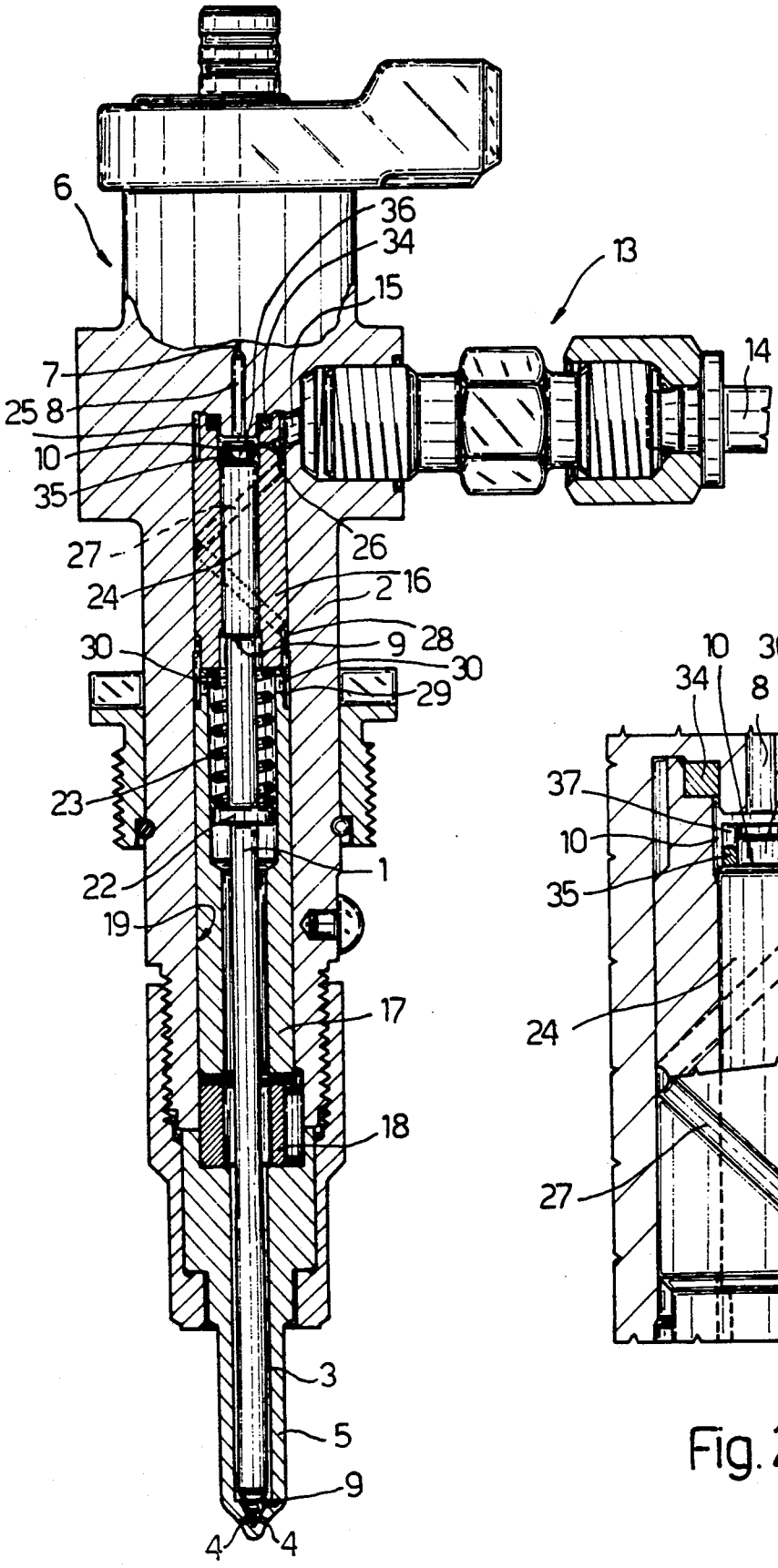
FIG. 1 shows an axial section of the injector according to the present invention.
Figure 2:
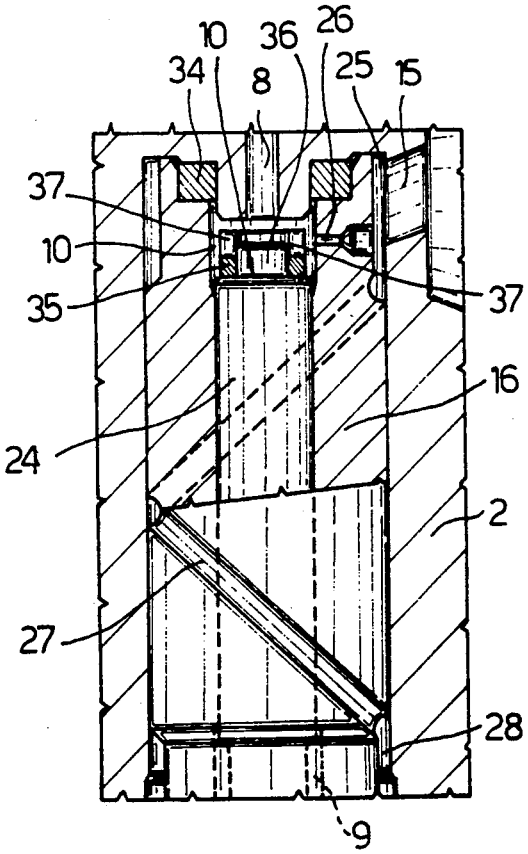
FIG. 2 shows a larger-scale detail of the FIG. 1 injector.

The injector according to the present invention substantially comprises a plunger 1 sliding inside the injector body 2, for controlling fuel passage between an injection chamber 3, located at the bottom of the injector, and at least one injection orifice 4 formed in an injection nozzle 5 secured to body 2, and coming out inside the combustion chamber of a cylinder on the engine.

Said injector also comprises an electromagnetic fuel metering valve 6 for controlling fuel passage through a drain orifice 7 between a control chamber 8, located at the top of the injector and supplied with fuel under pressure, and a low-pressure chamber (not shown). Plunger 1 presents surface portions 9 exposed to the fuel inside injection chamber 3, and surface portions 10 exposed to the fuel inside control chamber 8. The respective pressures inside chambers 3 and 8 thus act respectively on surface portions 9 and 10 for raising plunger 1, as described later on, when the pressure inside control chamber 8 falls to a given value.

According to the present invention, pressurized fuel is fed into injection chamber 3 and control chamber 8 by means of a single fitting 13 connected to a pressurized fuel supply pipe 14. Said fitting 13 comes out inside a supply orifice 15 formed in body 2 and communicating with control chamber 8 as described later on. Orifice 15 also communicates with injection chamber 3 via a duct formed substantially inside two sleeves 16 and 17 housed in an axial hole 19 in body 2, which also houses a third sleeve 18.

Plunger 1 presents a projection 22 on which rests one end of a helical spring 23 located between projection 22 and top sleeve 16 so as to normally secure the bottom end of plunger 1 against a seat on nozzle 5, thus closing injection orifices 4. A top portion 24 of plunger 1 is housed in sliding manner inside top sleeve 16 so as to guide plunger 1 as it slides longitudinally. According to the present invention, fuel supply orifice 15 comes out inside an annular chamber 25 formed between an outer surface portion of sleeve 16 and the surface of hole 19. Annular chamber 25 communicates with the inner cavity of sleeve 16, and consequently with control chamber 8, via at least one radial hole 26 formed in sleeve 16, and with a helical groove 27 formed on the outer surface of sleeve 16. Hole 26 and groove 27 form part of said duct supplying fuel from orifice 15 to injection chamber 3. The remaining portions of said duct are defined by a further two annular chambers 28, 29, one formed between an outer surface portion of sleeve 16 and the surface of hole 19, and the other between an outer surface portion of sleeve 17 and the same surface of hole 19. Said duct comes out inside injection chamber 3 via radial holes 30 in sleeve 17.

Between top sleeve 16 and the end surface of hole 19, there is provided a ring 34 for sealing between the cylindrical cavity of sleeve 16 and control chamber 8. A spacer ring 35 acts as an upward limit stop for plunger 1, and is conveniently centered on a pin 36 of plunger 1 and presents radial grooves 37.

The injector according to the present invention operates as follows.

Pressurized fuel is fed along pipe 14 and through fitting 13 into supply orifice 15. A first stream of pressurized fuel is thus fed into control chamber 8 through orifice 15, annular chamber 25 and radial hole 26; and a second stream into injection chamber 3 along the duct originating from annular chamber 25 and comprising helical groove 27, annular chambers 28 and 29 and radial holes 30.

Surface portions 9 and 10 exposed respectively to the fuel inside injection chamber 3 and control chamber 8 are thus subjected to the respective pressures inside said chambers. When metering valve 6 is de-activated, in which case the pressure is substantially the same in both chambers 3 and 8, the resultant of the pressures acting on surface portions 9 and 10 holds the end of plunger 1 against the seats on nozzle 5, thus closing injection orifices 4.

When, on the other hand, metering vale 6 is activated, a predetermined amount of fuel is allowed to flow from control chamber 8 through orifice 7, and the pressure inside control chamber 8 drops to a given value. The resultant of the pressures acting on plunger 1 is thus reversed, thus raising plunger 1 against the elastic reaction of spring 23, and enabling a predetermined amount of fuel to be supplied through injection orifices 4 of nozzle 5.

Besides providing for satisfactory, reliable operation, the injector according to the present invention may be employed indifferently on various types of engines requiring differing pressure reductions between fuel supply orifice 15 and control chamber 8. This is achieved by simply fitting the injector with a sleeve 16 having a radial hole 26 of such a size as to provide for the required fall in pressure. Injectors of different characteristics may thus be produced using the same components, with the exception of sleeve 16.

To those skilled in the art it will be clear that changes may be made to both the design and arrangement of the component parts of the embodiment described and illustrated herein without, however, departing from the scope of the present invention.

We claim:

1. A Diesel engine electromagnetic fuel injector comprising:

a plunger (1) sliding inside the injector body (2), for controlling fuel passage between an injection chamber (3), supplied with fuel under pressure, and at least one injection orifice (4) formed in an injection nozzle (5) secured to said body (2);

an electromagnetic fuel metering valve (6) for controlling fuel passage, through a drain orifice, between a control chamber (8), supplied with fuel under pressure, and a low-pressure chamber, so as to reduce the pressure of the fuel in said control chamber (8) by draining the same through said orifice;

surface portions of said plunger being exposed to the fuel inside said injection chamber (3) and said control chamber (8), so that the pressures inside said chambers and acting on said surface portions displace said plunger (1) when the pressure in said control chamber (8) falls to a given value;

said fuel under pressure being supplied to said injection chamber (3) and said control chamber (8) by means of a single fitting (13) connected to a supply pipe (14) and coming out inside a supply orifice (15) formed in said body (2) and communicating with said control chamber (8) and with a supply duct for feeding fuel into said injection chamber (3) and substantially formed inside a series of sleeves (16,17) housed inside an axial hole (19) in said body (2) and inside which said plunger (1) slides axially;

characterised by the fact that said fuel supply orifice (15) comes out inside an annular chamber (25) formed between the outer surface of the top sleeve (16) in said series and said axial hole (19) in said body (2); said annular chamber (25) communicating with said control chamber (8) via at least one radial hole (26) formed in said sleeve (16), and with a helical groove (27) formed on the outer surface of said sleeve (16) and defining the first portion of said duct supplying fuel to said injection chamber (3).

2. An injector as claimed in claim 1, characterised by the fact that said radial hole (26) formed in said sleeve (16) comes out inside the inner cavity of the same communicating with said control chamber (8).

3. An injector as claimed in claim 1 characterised by the fact that said cavity houses a spacer ring (35) acting as a limit stop for said plunger (1); said ring (35) being centered on a pin (36) of said plunger (1) and presenting at least one radial groove (37).

4. An injector as claimed in claim 1, characterised by the fact that said duct supplying said fuel to said injection chamber (3) also comprises a second (28) and third (29) annular chamber formed respectively between an outer surface portion of said top sleeve (16) and said axial hole (19), and between an outer surface portion of the sleeve (17) adjacent to said top sleeve (16) and said axial hole (19); and at least a radial hole formed in said sleeve (17).

* * * * *